United States Patent [19]

Haswell et al.

[11] 4,249,945

[45] Feb. 10, 1981

[54] POWDER-METALLURGY STEEL ARTICLE WITH HIGH VANADIUM-CARBIDE CONTENT

[75] Inventors: Walter T. Haswell, Jamesville, N.Y.; August Kasak, Pittsburgh, Pa.

[73] Assignee: Crucible Inc., Pittsburgh, Pa.

[21] Appl. No.: 944,514

[22] Filed: Sep. 20, 1978

[51] Int. Cl.[3] ..... B22F 5/00

[52] U.S. Cl. ..... 75/241; 75/243

[58] Field of Search ..... 75/243, 241

[56] References Cited

U.S. PATENT DOCUMENTS

| | | | |
|---|---|---|---|
| 3,150,444 | 9/1964 | Reen | 29/420.5 |
| 3,591,349 | 7/1971 | Benjamin | 75/243 |

OTHER PUBLICATIONS

Roberts et al. *Tool Steels* 1962 ASM 3rd Ed. pp. 189, 192, 521-523, 699-705.

*Primary Examiner*—Brooks H. Hunt
*Attorney, Agent, or Firm*—Clair X. Mullen, Jr.

[57] ABSTRACT

A powder metallurgy tool steel article for use in applications requiring high wear resistance having a carbide content of 10 to 18 volume percent of substantially all MC-type vanadium carbides, which carbides are substantially spherical and uniformly dispersed; the carbon content of the article is balanced relative to the carbide formers vanadium, chromium and molybdenum to provide an amount of carbon in the matrix of the article sufficient to permit the article to be heat treated to a hardness of at least 56 $R_c$.

3 Claims, 10 Drawing Figures

MC TYPE CARBIDES IN STEEL CPM 6V

MC TYPE CARBIDES IN STEEL CPM 10V

MC TYPE CARBIDES IN STEEL CPM 11V

MC TYPE CARBIDES IN STEEL CPM 14V

MC TYPE CARBIDES IN STEEL C6V

MC TYPE CARBIDES IN STEEL C11V

POWDER-METALLURGY STEEL ARTICLE WITH HIGH VANADIUM-CARBIDE CONTENT

It is known that tool steels and articles made therefrom benefit from the standpoint of wear resistance from the presence of substantial amounts of an MC-type carbide dispersion. However, as the carbide content is increased, the workability of the steel is impaired. Consequently, with conventionally melted and cast alloys of this type a practical limit is placed upon the total MC-type carbide content.

Specifically, tool steels and articles made therefrom are required to have a combination of yield strength to withstand deformation under the high stresses encountered in service, wear resistance to withstand wear during contact with the workpiece, such as during rolling, extruding, blanking, punching, slitting and the like, and toughness to prevent breaking-away or chipping of the tool during contact with the workpiece. For this purpose it is known to use tool steels having an alloy-steel matrix with a dispersion of carbide particles, with the carbide particles being present for purposes of wear resistance and the matrix providing the desired strength and toughness. Consequently, in alloys of this type it is accepted that the wear resistance thereof is increased with increasing carbide content and particularly MC-type vanadium carbides. Carbides of this type contribute most significantly to wear resistance because of their relative hardness. For this reason, large amounts of MC-type vanadium carbides are obtained by stoichiometrically balancing the MC-type carbide former vanadium with carbon. The stoichiometric relationship for MC-type vanadium carbide formation is 1% vanadium and 0.20% carbon.

As recognized, with increases in this carbide content the toughness of the steel is reduced; in addition, however, the toughness and workability are adversely affected by carbide segregation which occurs during solidification of ingots or other castings of the alloy; growth of the carbide particles to an unduly large size is unavoidable. Consequently, with conventional tool steels the MC-type vanadium carbide content is limited to a maximum of about 8.2% by volume.

U.S. Pat. No. 3,746,518 discloses cobalt, iron and nickel base alloys with a plurality of carbide-forming elements in a general way but does not discriminate among the various matrix materials as well as among the various carbide-forming elements or set an upper limit with respect to any of the carbide-forming elements. Evidently, these factors were not considered important. In contrast, the present invention deals exclusively with iron-base alloys and with vanadium as the critical carbide-forming elements and sets critical limits with respect to the vanadium and vanadium carbide content.

It is accordingly the primary object of this invention to provide a powder-metallurgy steel article having a high content of substantially spherical and uniformly distributed MC-type vanadium carbides, which impart greatly improved wear resistance to the article while maintaining toughness and workability at acceptable levels.

This and other objects of the invention, as well as a more complete understanding thereof, may be obtained from the following description, specific examples and drawings, in which.

Figure 1:
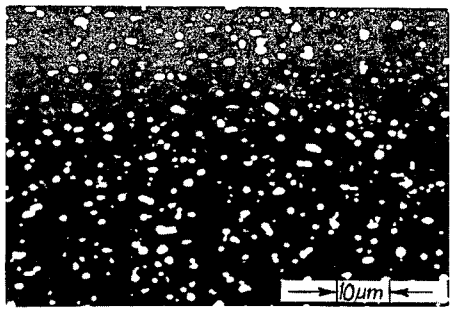
FIG. 1 is a photomicrograph of a portion of a tool steel article produced in accordance with the present invention and showing the characteristic MC-type vanadium carbide formation in the alloy matrix.
Figure 2:
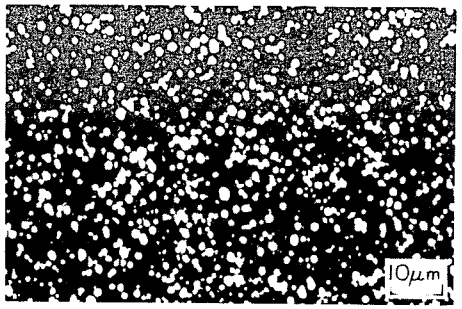
FIG. 2 is a photomicrograph similar to FIG. 1, except with a higher MC-type vanadium carbide content also in accordance with the invention.
Figure 3:
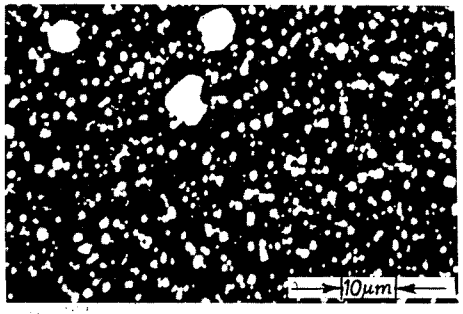
FIG. 3 is a photomicrograph similar to FIGS. 1 and 2, except with a still higher MC-type vanadium carbide content which is at the upper, permissible limit of the invention.
Figure 4:
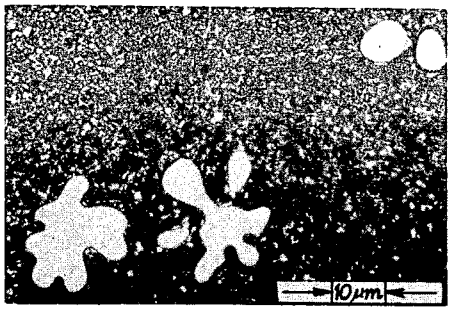
Figure 5:
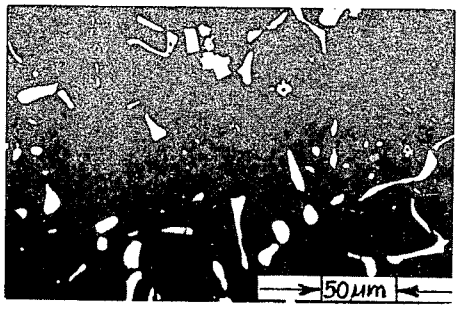
Figure 6:
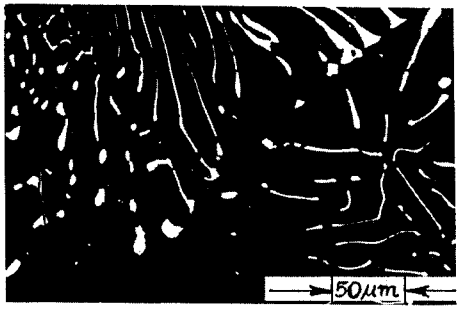
Figure 7:
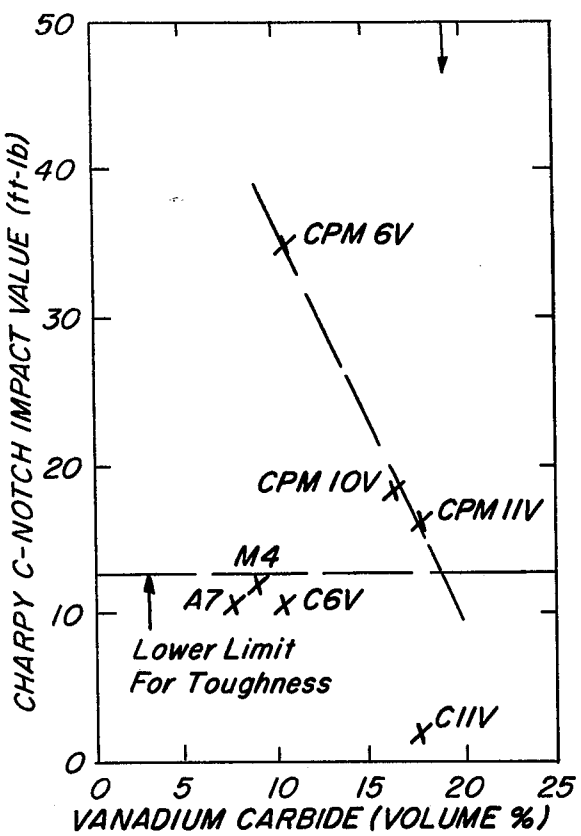
Figure 8:
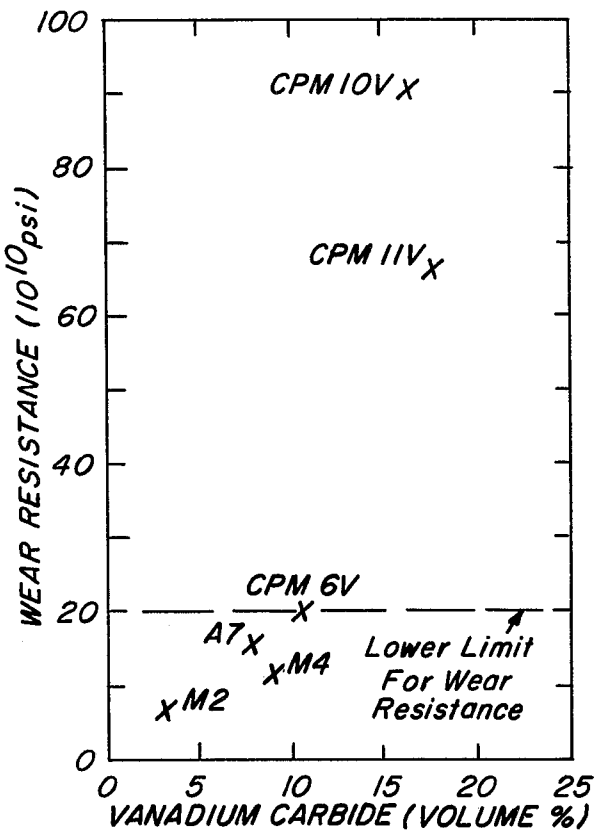
Figure 9:
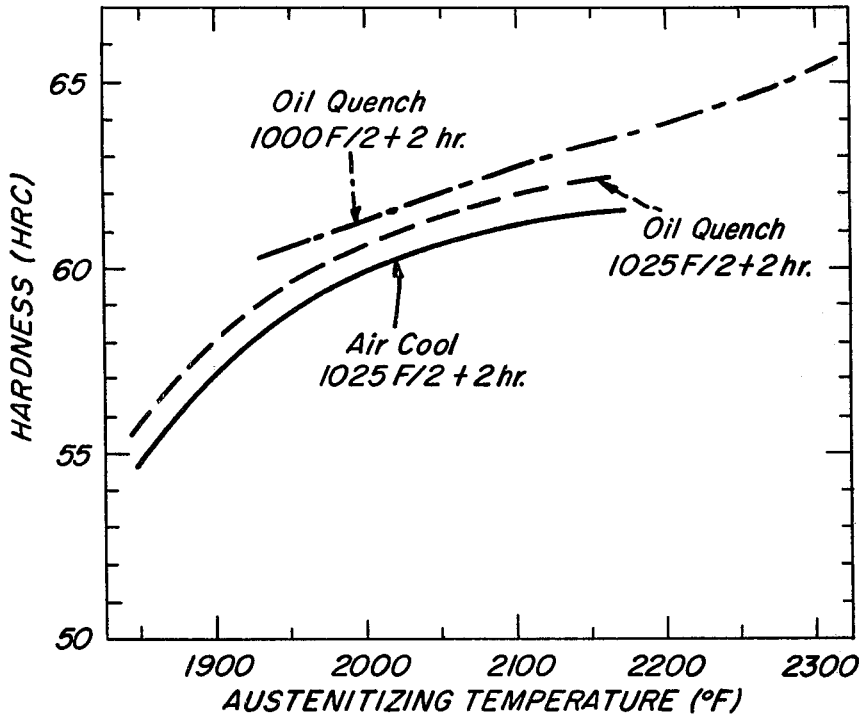
Figure 10:
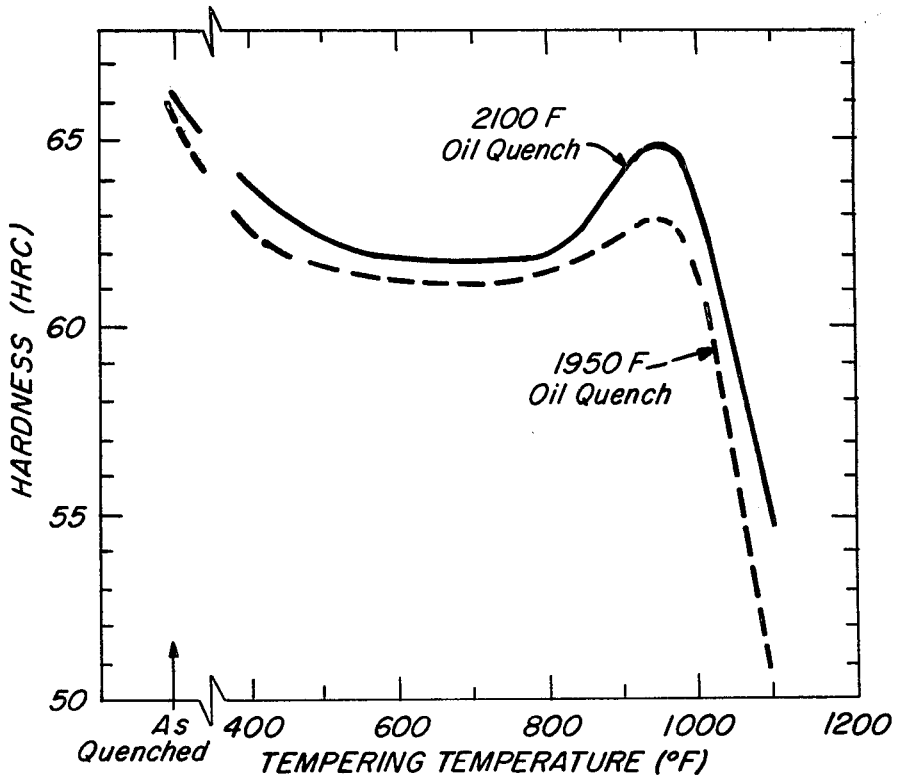

FIG. 4 likewise is a photomicrograph similar to FIGS. 1, 2 and 3, except that the MC-type vanadium carbide content exceeds the upper limit of the invention, and some of these carbides are larger than 15 microns in size, not substantially spherical and not uniformly distributed in accordance with the invention;

FIG. 5 is a photomicrograph of a portion of a tool steel article having a composition, and specifically a vanadium content, in accordance with the invention but of an ingot cast article rather than a powder metallurgy produced article;

FIG. 6 is a photomicrograph of a portion of a tool steel article similar to the article of FIG. 5 but having a higher vanadium content;

FIG. 7 is a graph showing the relationship between impact toughness and MC-type vanadium carbide content;

FIG. 8 is a graph showing the relationship between wear resistance and MC-type vanadium carbide content;

FIG. 9 is a graph showing the effect of austenitizing treatment on the hardness of a powder metallurgy article in accordance with the invention and identified as sample CPM 10V; and FIG. 10 is a graph showing the effect of tempering temperaure at a tempering time of 2+2 hours on the hardness of a powder metallurgy article in accordance with the invention and identified as sample CPM 10V.

The term "MC-type vanadium carbide" as used herein refers to the carbide characterized by the face-centered-cubic crystal structure with "M" representing the carbide-forming element essentially vanadium; this also includes $M_4C_3$-type vanadium carbides and includes the partial replacement of carbon by nitrogen and/or oxygen to encompass what are termed "carbonitrides" and "oxycarbonitrides". Although the powder metallurgy article of this invention is defined herein as containing substantially all MC-type vanadium carbides, it is understood that other types of carbides, such as $M_6C$, $M_2C$, and $M_{23}C_6$ carbides, may also be present in minor amounts, but are not significant from the standpoint of achieving the objects of the invention.

The term "powder metallurgy article" as used herein is used to designate a compacted prealloyed particle charge that has been formed by a combination of heat and pressure into a coherent mass having a density, in final form, in excess of 99% of theoretical density; this includes intermediate products such as billets, blooms, rod and bar and the like, as well as final products such as tool steel articles including rolls, punches, dies, wear plates and the like, which articles may be fabricated from intermediate product forms from the initial prealloyed particle charge.

Broadly in the practice of the invention a prealloyed powder charge is obtained wherein each particle thereof has an alloy steel matrix with a uniform dispersion of MC-type vanadium carbides within the range of 10 to 18%, preferably 15 to 17% or 13.3 to 17.2% by volume. The carbides are of substantially spherical shape and are uniformly distributed. More specifically the prealloyed powder from which the powder metallurgy article of the invention is formed has a metallurgical composition, in weight percent, and MC-type vanadium carbide content, in volume percent, within the following ranges:

| | Broad | Preferred | Preferred |
|---|---|---|---|
| Manganese | .2 to 1.5 | .4 to .6 | .2 to 1 |
| Silicon | 2 max. | 1 max. | 2 max. |
| Chromium | 1.5 to 6 | 5 to 5.5 | 4.5 to 5.5 |
| Molybdenum | .50 to 6 | 1.15 to 1.4 | .80 to 1.7 |
| Sulfur | .30 max. | .09 max. | .14 max. |
| Vanadium | 6 to 11 | 9.25 to 10.25 | 8 to 10.5 |
| Carbon | 1.6 to 2.8 | 2.40 to 2.50 | 2.2 to 2.6 |
| Iron* | Bal. | Bal. | Bal. |
| MC-type vanadium carbides (percent by volume) | ~10 to 18 | ~15 to 17 | ~13.3 to 17.2 |

*includes incidental elements and impurities characteristic of steelmaking practice The article of the invention is further characterized by the MC-type vanadium carbides being substantially spherical and uniformly distributed. The carbon content is balanced with the vanadium, chromium and molybdenum contents to provide sufficient carbon to permit the powder metallurgy article to be heat treated to a hardness of at least 56 $R_c$.

Further with respect to the metallurgical composition of the prealloyed powder if the manganese content is outside the upper limit set forth above, the resulting article is difficult to anneal to the low hardness required for machining purposes. On the other hand if manganese is too low there will not be sufficient manganese present to form the manganese sulfides necessary to provide adequate machinability. If the silicon exceeds the maximum limit the hardness of the article will be too high in the annealed condition for machining. Chromium is required for adequate hardenability during heat treatment and, in addition, promotes elevated-temperature strength. If the chromium content is too high, this leads to the formation of high-temperature ferrite or retention of unduly large amounts of austenite during heat treatment. The formation of high-temperature ferrite adversely affects hot-workability, and retained austenite impairs attainment of the desired high hardness levels during heat treatment. Molybdenum, like chromium, imparts high temperature strength and hardenability to the alloy article. Sulfur promotes machinability by providing for the formation of manganese sulfides. Carbon should be balanced with vanadium for purposes of forming MC-type vanadium carbides to provide wear resistance. Also, it is necessary for adequate matrix hardening that the carbon be present in an amount to combine with all of the vanadium present and additionally be present for matrix strengthening.

A particle charge of this character may be compacted by any powder metallurgy technique to the desired product form so long as such technique does not cause excessive, detrimental growth and agglomeration of the carbides. It is preferred to use the well known technique of hot isostatic pressing of an enclosed charge of prealloyed, atomized powder in an autoclave.

This invention deals with powder-metallurgically produced alloy steel compositions and powder metallurgy articles that contain substantially all MC-type vanadium carbides. Furthermore, by controlling the vanadium content and the MC-type vanadium carbide content at critical levels a heretofore unobtainable combination of wear resistance and toughness, along with acceptable grindability is achieved.

The invention is illustrated by the alloys reported in Table I. The alloys CPM 6V, CPM 11V and CPM 14V were prepared by (1) making prealloyed powder by induction melting and gas atomization, (2) screening the powder to −40 mesh size (U.S. Standard), (3) placing the powder in 5½ in. diameter×6 in. high mild steel cans, (4) outgassing and sealing the cans, (5) heating the cans to 2140° F. and holding at that temperature for nine hours, (6) consolidating by action of isostatic pressure of 13.2 ksi to essentially full density, and (7) cooling to ambient temperature. The compacts were then readily hot forged (using 2000° F. forging temperature) to 1 in. square bars from which various test specimens were prepared.

TABLE I

IDENTIFICATION AND CHARACTERIZATION OF EXPERIMENTAL STEELS

| Designation of Steel | Internal Code | Method of Manufacture | MC-Type Vanadium Carbide Content (Vol. %) | Chemical Composition (Wt. %) C | Mn | Si | Cr | V | Mo | Fe |
|---|---|---|---|---|---|---|---|---|---|---|
| CPM 6V | 391-79 | P/M | 10.5 | 1.62 | 0.26 | 1.97 | 1.56 | 6.30 | 0.81 | Bal. |
| CPM 11V | 391-81 | P/M | 17.7 | 2.50 | 0.27 | 1.76 | 1.66 | 10.84 | 0.92 | Bal |
| CPM 14V | 515-18 | P/M | 22.7 | 3.04 | 0.42 | 2.08 | 1.28 | 14.10 | 1.16 | Bal. |
| C6V | 2455 | Ingot Cast | 10.2 | 1.60 | 0.49 | 2.10 | 1.50 | 6.10 | 0.60 | Bal. |
| C11V | 2456 | Ingot Cast | 18.2 | 2.66 | 0.53 | 2.34 | 1.20 | 11.16 | 1.00 | Bal. |
| CPM 10V | P 67216-2 (CRC 75-73) | P/M | 16.2 | 2.40 | 0.45 | .89 | 5.25 | 9.85 | 1.26 | Bal. |
| CPM 16V | 456-401 | P/M | 25.4 | 3.49 | 0.50 | 0.91 | 4.83 | 15.94 | 1.32 | Bal. |

For comparison purposes, similar compositions identified as C6V and C11V were induction melted in the form of 100-lb. heats and teemed into 5-in. square molds lined with refractory brick. These ingots were then subjected to forging (using 2000° F. heating temperature) by the same schedule as had been used on the corresponding powder metallurgy compacts CPM 6V and CPM 11V. The C6V steel reported in Table I could be forged, exercizing appreciable care, to 3-in. square bar; whereas, the C11V steel reported in Table I suffered severe cracking on the initial forging reduction and thus proved to be practically unworkable. The distinctly superior hot workability of the powder metallurgy products CPM 6V and CPM 11V was conclusively indicated by this experiment.

The material of CPM 10V was prepared by (1) making prealloyed powder by induction melting and gas atomization, (2) screening the powder to −16 mesh size (U.S. Standard), (3) placing the powder in a 12¾-in. diameter O.D.×60-in. high mild steel can, (4) outgassing the can, (5) heating the can to 2150° F., (6) consolidating by action of isostatic pressing of 12 ksi to essentially full density, (7) cooling to ambient temperature.

The compact was then (1) heated to 2100° F., (2) hot rolled to billet with 10½×3-in. cross section, (3) annealed, (4) conditioned, (5) heated to 2075° F., (6) forged to 8.469×1.969-in. cross section, and (7) machined to 8.015×1.765-in. cross section.

The material of CPM 16V was prepared by (1) making prealloyed powder by induction melting and gas atomization, (2) screening the powder to −20 mesh size (U.S. Standard), (3) placing the powder in a 1 in. diameter I.D.×4-in. high mild steel can, (4) outgassing the can, (5) heating the can to 2175° F., and (6) consolidating by the action of a forging press to essentially full density.

To obtain an evaluation of the performance characteristics of the alloys, determinations of the key properties pertaining to their application in cold work tooling were conducted. These included: (1) microstructure, (2) hardness in the heat treated condition as a measure of strength, (3) bend fracture strength as well as impact value as measures of toughness and (4) wear rate in the cross-cylinder wear test as a measure of wear resistance.

The characteristics of the MC-type vanadium carbides in articles of Steels CPM 6V, CPM 10V, CPM 11V, CPM 14V, C6V and C11V are illustrated in FIGS. 1, 2, 3, 4, 5 and 6, respectively. By application of a known special selective etching technique (successive application of picral and Murakami's reagents[1]), the MC-type vanadium carbides are made to appear as white particles on a dark background (containing all other microconstituents). It is clearly evident that the MC-type vanadium carbide particles are uniformly distributed, small in size, and essentially spherical in shape in Steels CPM 6V, CPM 10V and CPM 11V of FIGS. 1, 2 and 3, respectively. In these steels, at least 90% of the MC-type vanadium carbides are less than 3 microns in size and none are substantially greater than 15 microns in size in any dimension. On the other hand, CPM 14V of FIG. 4 and the ingot-cast Steels C6V and C11V of FIGS. 5 and 6, respectively, are characterized by the presence of distinctly larger angularly shaped, e.g. non-spherical, MC-type vanadium carbides. These large angularly shaped carbides appear in clusters throughout the microstructure of the article and result in a nonuniform MC-type vanadium carbide distribution. With regard to the characteristics of the MC-type vanadium carbides, Steels CPM 6V, CPM 10V and CPM 11V are illustrative of the MC-type vanadium carbide appearance of articles within the scope of this invention; whereas, those in Steels CPM 14V, C6V and C11V are characteristic of articles outside the scope of the invention.

[1]Picral consists of 5 grams picric acid in 100 ml ethyl alcohol; Murakami's reagent consists of 10 grams potassium ferricyanide and 7 grams of sodium hydroxide in 100 ml of water.

In addition to the MC-type vanadium carbide size, shape and distribution, this invention emphasizes the importance of the amount of the MC-type vanadium carbides present in the articles. The amount of MC-type vanadium carbides present in Steels CPM 6V, CPM 10V, CPM 11V, CPM 14V, C6V and C11V was computed based on the well accepted fact that the vanadium content of the steel is present in the form of MC or $M_4C_3$ type carbides, where M is essentially all vanadium and the vanadium/carbon ratio is 5:1, in weight percent. It is understood that in alloys of this type tungsten is usually present as a "tramp" element, although it is not intentionally added for any purpose. For the further materials used for comparison purposes, the volume percentages for AISI A7 and D7 were computed on the same basis as for the experimental steels using the nominal vanadium contents of 4.75 and 4.0 weight percent, respectively, as the vanadium contents of the steels. For AISI M2 and M4 high speed steels, the volume percentages of MC-type vanadium carbide contents were taken from a technical publication by Kayser and Cohen in Metal Progress, June 1952, pages 79–85.

Hardness is a measure of the ability of the steel to resist deformation during service in cold-work or warm-work tooling. A minimum hardness of $R_c$ 56 is usually required. The results presented in Table II were obtained on hardness testing in accordance with ASTM E18-67 Standard after a heat treatment consisting of austenitizing at 1750° F. for 1 hour, oil quenching and tempering at 500° F. for 2+2 hours.

TABLE II

| Description of Steel | Type of Manufacture | MC-Type Vanadium Carbide Content (Vol. %) | Hardness ($R_c$) |
|---|---|---|---|
| CPM 6V | P/M | 10.5 | 62 |
| C6V | Ingot Cast | 10.2 | 56 |
| CPM 11V | P/M | 17.7 | 63 |
| C11V | Ingot Cast | 18.2 | 50 |

Superiority of the product produced in accordance with the invention (CPM 6V and CPM 11V) over the ingot-cast product (C6V and C11V) in heat treating response is clearly evident.

Specimens of CPM 10V have been subjected to a wide variety of heat treatments consisting of austenitizing, cooling and tempering. The results of austenitizing are presented in FIG. 9 wherein the time-at-temperature relationship was as follows:

| Temperature (°F.) | Time (Minutes) |
|---|---|
| 1850 | 60 |
| 1950 | 60 |
| 2100 | 15 |
| 2150 | 10 |
| 2200 | 4 |
| 2300 | 4 |

The results of tempering treatment are shown in FIG. 10. From these FIGS. it is evident that the heat treated hardness of 56 $R_c$ can be achieved for articles of the invention in the austenitized and tempered condition over a broad treatment range.

Bend fracture strength is a measure of toughness. The determination of this property is made at the ambient temperature on specimens ¼ in. sq.×1⅞-in. long using three-point loading with a 1½-in. support span and applying a bending rate of 0.1 in. per minute. The bend fracture strength is the stress which causes fracturing of the specimen. It is calculated using the following formula:

$$S = \frac{3\,PL}{2bh^2}$$

where

S is the bend fracture strength (psi or ksi)
P is the load required to cause fracture (lb.)
L is the support span (in.)
b is the specimen width (in.)
h is the specimen height (in.)

The results reported in Table III were obtained in testing specimens that had been heat treated by austenitizing at 1750° F. for 1 hour, oil quenching and tempering at 500° F. for 2+2 hours.

TABLE III

| Designation of Steel | Type of Manufacture | Bend Fracture Strength (ksi) |
|---|---|---|
| CPM 6V | P/M | 700 |
| C6V | Ingot Cast | 420 |

The superiority of the powder-metallurgy prepared product in accordance with the invention is clearly evident.

Impact toughness tests were conducted on Charpy-type specimens at room temperature in accordance with the ASTM E23-72 procedure on specimens having a notch radius of ½ in. The results reported in Table IV were obtained.

TABLE IV

| Designation of Steel | Type of Manufacture | MC-Type Vanadium Carbide Content (Vol. %) | Hardness ($R_c$) | Impact Value (ft-lb) |
|---|---|---|---|---|
| CPM 6V | P/M | 10.5 | 62 | 35 |
| CPM 10V | P/M | 16.2 | 63 | 18 |
| CPM 11V | P/M | 17.7 | 63 | 16 |
| C6V | Ingot Cast | 10.2 | 56 | 11 |
| C11V | Ingot Cast | 18.2 | 50 | 1.5 |
| AISI Type A7* | Ingot Cast | 8.0 | 61 | 11 |
| AISI Type M4* | Ingot Cast | 9.0 | 63 | 12 |

*from commercial stock

From Table IV it may be seen that the articles of this invention, even with substantially greater carbide content, were superior in toughness to the conventional commercial cold-work or warm-work tool materials in their optimum heat treated condition for coldwork tooling application.

The toughness data reported in Table IV are graphically presented in FIG. 7. These data show that with MC-type vanadium carbide contents exceeding about 18% by volume the toughness of product in accordance with the invention decreases to the toughness level achieved conventionally and thus this advantage of the invention is lost.

For evaluation of wear resistance, the crossed-cylinder wear test was used. In this test, a cylindrical specimen (⅝ in. diameter) of the respective cold-work or warm-work tool material and a cylindrical specimen (½ in. diameter) of tungsten carbide (with 6% cobalt binder) are positioned perpendicularly to one another. A fifteen-pound load is applied through weight on a lever arm. Then the tungsten carbide cylinder specimen is rotated at a speed of 667 revolutions per minute. No lubrication is applied. As the test progresses, a wear spot develops on the specimen of the tool material. From time to time, the extent of wear is determined by measuring the depth of the wear spot on the specimen and converting it into wear volume by aid of a relationship specifically derived for this purpose. The wear resistance, or the reciprocal of the wear rate, is then computed according to the following formula:

$$\text{Wear resistance} = \frac{1}{\text{wear rate}} = \frac{L\,\Delta s}{\Delta v} = \frac{L\,\pi\,d\,\Delta N}{\Delta v}$$

where v = the wear volume, (in.$^3$)

L = the applied load, (lb.)

s = the sliding distance, (in.)

d = the diameter of the tungsten carbide cylinder, (in.) and

N = the number of revolutions made by the tungsten carbide cylinder, (rpm)

This test has provided excellent correlations with wear situations encountered in practice.

Applying this wear test to specimens of this invention, as well as to some currently widely used highly wear-resistant cold-work or warm-work tooling materials from commercial stock, the data reported in Table V resulted:

TABLE V

| Designation of Steel | Type of Manufacture | Hardness ($R_c$) | MC-Type Vanadium Carbide Content (Vol. %) | Wear Resistance ($10^{10}$ psi) |
|---|---|---|---|---|
| CPM 11V | P/M | 63 | 17.7 | 66 |
| CPM 10V | P/M | 63 | 16.2 | 90 |
| CPM 6V | P/M | 62 | 10.5 | 20 |
| AISI A7* | Ingot Cast | 61 | 8.0 | 15 |
| AISI D7* | Ingot Cast | 61 | 6.7 | 7 |
| AISI M4* | Ingot Cast | 63 | 9.0 | 11 |
| AISI M2* | Ingot Cast | 64 | 3.1 | 6 |

*from commercial stock

The superiority of the alloys of this invention with regard to wear resistance is clearly evident from the reported data. Specifically, as shown in Table V and FIG. 8, the wear resistance of the CPM 10 sample is significantly superior to the wear resistance of the CPM 11 sample, which has a higher MC-type vanadium carbide content and thus would be expected to have higher wear resistance. As may be seen from FIG. 8 a minimum MC-type vanadium carbide content of 10% by volume is needed to attain a significant advantage in wear resistance over conventional material. Therefore, a minimum MC-type vanadium carbide content is established by these data for articles in accordance with the invention. The upper limit with respect to the MC-type vanadium carbide content is established by the finding that the relatively large-sized MC-type vanadium carbides that are present in the microstructure of steels having vanadium contents of about 11% or higher or MC-type vanadium carbide contents of about 18% or higher by volume have a deleterious effect on the grindability of the steel. Grindability is an important consideration because grinding is often used in the manufacture of tools and other wear-resistant articles from steels of this type. The effect of the MC-type vanadium carbide size on grindability is evident from the results of the following experiment conducted on samples from Steels CPM 10V and CPM 16V. These two steels have essentially the same chemical compositions except for their vanadium and carbon contents, and their MC-type vanadium carbide contents; CPM 10V is within the scope of this invention, whereas CPM 16V is not.

Specimens of both steels were rough machined and heat treated by austenitizing at 2150° F. for 4 minutes, oil quenching, and tempering at 1000° F. for 2+2 hours. After this treatment, the hardness of the CPM 10V steel was 63.5 $R_c$ and that of the CPM 16V steel was 64.5 $R_c$. The specimens were then finish machined to the final size: 1.234 in. (length) by 0.398 in. (width) by 0.344 in. (thickness).

The grindability evaluation was done by use of a Norton horizontal-spindle surface grinding machine equipped with a reciprocating table and magnetic chuck. The grinding conditions used were as follows:

Cross feed—0.008 in.
Cross speed—92 ft./min.
Down feed—0.0010 in./pass
Grinding wheel—4A-54-H-10-V-FM
Grinding wheel speed—2000 rpm
Coolant—CX-30S
Specimen surface area subjected to grinding—0.49 in.$^2$ Before each test, the specimen thickness was measured with a micrometer. After ten passes (with a grinding wheel down feed of 0.0010 in./pass), the specimen thickness was remeasured and the change in specimen thickness calculated. The difference between the down feed of the grinding wheel in 10 passes ($10\times0.0010=0.010$ in.) and the measured resulting change in the specimen thickness indicates the wear of the grinding wheel in terms of its radius. The smaller the wear of the grinding wheel, the better is the grindability of the workpiece material.

Three tests were run on each of the specimens CPM 10V and CPM 16V. The grinding wheel was dressed before each test.

By using the procedure described above, the following results were obtained:

| Steel | Change in Specimen Thickness (in.) | | | | Average Grinding Wheel Wear* (in.) |
|---|---|---|---|---|---|
| | | | | Average | |
| 10V | .0097, | .0096, | .0098 | .0097 | .0003 |
| 16V | .0091, | .0093, | .0091 | .0092 | .0008 |

*Determined as the difference between the down feed of grinding wheel in 10 passes (.0100 in.) and the average change in specimen thickness in 10 passes.

It is evident from these results that the 16V specimen, which is outside the scope of the invention from the standpoint of the MC-type vanadium carbide content being above the upper limit of the invention, exhibits unsatisfactory grindability and significantly inferior to the grindability of the 10V specimen that is within the scope of the invention.

Bars (0.756 in. diameter) of Steel CPM 11V were manufactured into "cold extrusion punches" and subjected to actual service as punches involved in the production of spark plug shells from AISI 1008 steel. The performance of punches is determined by the number of shells produced before undue wear necessitates their replacement. The results reported in TABLE VI were obtained.

TABLE VI

| Extrusion Punch Material | MC-Type Vanadium Carbide Content (Vol. %) | Average No. of Parts Produced Per Punch (in 1000) |
|---|---|---|
| CPM 11V | 17.7 | 42 |
| AISI M4* | 9.0 | 22 |

*from commercial stock

The performance advantage of the alloy of this invention, CPM 11V, over the AISI Type M4 high-speed steel is clearly evident.

As another illustration, a punch made of CPM 10V steel was used as a tool for punching slots into iron-oxide-coated tags. Forty million tags were produced without wear or buildup on the tool. In comparison, the same tool made from AISI D7 (containing 4% vanadium or 6.7 volume percent of vanadium carbide) failed after producing 8,000,000 to 12,000,000 tags.

As a further trail application, a punch was made of CPM 10V and used in punching slots in 0.015 inch-thick copper-beryllium alloy strip for producing electronic parts. While the same punch made of AISI D2 cold-work tool steel heat treated to $R_c$ 60 to 62 hardness is normally worn out after producing 75,000 parts and one made of AISI M4 high speed steel heat treated to $R_c$ 64 hardness shows some wear after producing 200,000 parts, the punch made of CPM 10V heat treated to $R_c$ 60 hardness showed no wear after producing 200,000 parts.

The articles of this invention are fabricable into tooling components without undue difficulties. They can be annealed to 250 to 300 Brinell hardness and machined, ground, drilled, etc., as needed to form the desired tool shape.

We claim:

1. A powder metallurgy article formed from compacted prealloyed powder of an alloy consisting essentially of, in weight percent, manganese 0.2 to 1.5, silicon 2 max., chromium 1.5 to 6, molybdenum 0.50 to 6, sulfur 0.30 max., vanadium 6 to 11, carbon 1.6 to 2.8, balance iron and incidental elements and impurities characteristic of steelmaking practice, said article having a dispersion of substantially all MC-ype vanadium carbides within the range of about 10 to 18 percent by volume, whereby said article is characterized by improved wear resistance with toughness and workability at acceptable levels, said carbides being substantially spherical and uniformly distributed, said carbon being balanced with the chromium, molybdenum and vanadium to provide sufficient carbon to permit said article to be heat treated to a hardness of at least 56 $R_c$.

2. The powder metallurgy article of claim 1 wherein the powder metallurgy article is formed of prealloyed powder of an alloy consisting essentially of, in weight percent, manganese 0.4 to 0.6, silicon 1 max., chromium 5 to 5.5, molybdenum 1.15 to 1.4, sulfur 0.09 max., vanadium 9.25 to 10.25, carbon 2.40 to 2.50, balance iron and incidental elements and impurities characteristic of steelmaking practice, said article having a dispersion of substantially all MC-type vanadium carbides within the range of about 15 to 17 percent by volume whereby said article is characterized by improved wear resistance with toughness and workability at acceptable levels.

3. The powder metallurgy article of claim 1 wherein the powder metallurgy article is formed of prealloyed powder of an alloy consisting essentially of, in weight percent, manganese 0.2 to 1, silicon 2 max., chromium 4.5 to 5.5, molybdenum 0.80 to 1.7, sulfur 0.14 max., vanadium 8 to 10.5, carbon 2.2 to 2.6, balance iron and incidential elements and impurities characteristic of steelmaking practice, said article having a dispersion of substantially all MC-type vanadium carbides within the range of about 13.3 to 17.2 percent by volume whereby said article is characterized by improved wear resistance with toughness and workability at acceptable levels.

* * * * *